US008266826B2

(12) United States Patent
Cassiday et al.

(10) Patent No.: US 8,266,826 B2
(45) Date of Patent: Sep. 18, 2012

(54) ARTICLE OF FOOTWEAR WITH SOLE STRUCTURE

(75) Inventors: Patrick Cassiday, Portland, OR (US); Randall Wyszynski, Portland, OR (US); Taeyong Lee, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 735 days.

(21) Appl. No.: 11/869,506

(22) Filed: Oct. 9, 2007

(65) Prior Publication Data

US 2009/0090025 A1 Apr. 9, 2009

(51) Int. Cl.
*A43B 21/28* (2006.01)
*A43B 13/20* (2006.01)

(52) U.S. Cl. ..... 36/35 B; 36/29

(58) Field of Classification Search ..... 36/35 B, 36/29, 153, 154, 28

See application file for complete search history.

(56) References Cited

U.S. PATENT DOCUMENTS

| | | | | |
|---|---|---|---|---|
| D350,016 | S | 8/1994 | Passke et al. | |
| 5,425,184 | A * | 6/1995 | Lyden et al. | 36/29 |
| D362,747 | S | 10/1995 | Orzeck | |
| D362,954 | S | 10/1995 | Orzeck | |
| D363,372 | S | 10/1995 | Hatfield et al. | |
| D373,674 | S | 9/1996 | Dolinsky | |
| D375,619 | S | 11/1996 | Backus et al. | |
| D395,337 | S | 6/1998 | Greene | |
| D396,551 | S | 8/1998 | Choi et al. | |
| D407,540 | S | 4/1999 | Dolinsky | |
| D408,618 | S | 4/1999 | Wilborn et al. | |
| 5,901,467 | A | 5/1999 | Peterson | |
| D410,964 | S | 6/1999 | Wilborn et al. | |
| D411,579 | S | 6/1999 | Dolinsky | |
| 5,987,780 | A * | 11/1999 | Lyden et al. | 36/29 |
| D419,284 | S | 1/2000 | Dolinsky | |
| 6,044,577 | A * | 4/2000 | Clark | 36/3 B |
| 6,055,746 | A | 5/2000 | Lyden et al. | |
| 6,665,958 | B2 * | 12/2003 | Goodwin | 36/29 |
| 6,837,590 | B2 * | 1/2005 | Marston | 362/103 |

(Continued)

FOREIGN PATENT DOCUMENTS

| | | |
|---|---|---|
| EP | 1447019 | 8/2004 |

(Continued)

OTHER PUBLICATIONS

Notification of Transmittal of the International Search Report and the Written Opinion of the International Searching Authority, mailed Jan. 12, 2009 in corresponding PCT Application No. PCT/US2008/078773.

(Continued)

*Primary Examiner* — Ted Kavanaugh
(74) *Attorney, Agent, or Firm* — Banner & Witcoff, Ltd.

(57) ABSTRACT

An article of footwear includes an upper and a sole structure including a midsole and an outsole. The footwear also includes at least one lobe between the upper and the outsole that extends laterally beyond a heel area of the upper and meets the sole at the lobe's edge that is laterally farthest away from the upper so that the lobe is exposed such that when viewed from above, in a direction perpendicular to the sole, the lobe is at least partially visible beyond the sides of the heel. The footwear may include a heel plate that extends laterally beyond the heel area of the upper. Further, the lobe may be a fluid-filled air bladder.

18 Claims, 6 Drawing Sheets

U.S. PATENT DOCUMENTS

| | | | | |
|---|---|---|---|---|
| 6,848,201 | B2 * | 2/2005 | Staffaroni et al. | 36/35 B |
| 6,925,732 | B1 | 8/2005 | Clarke | |
| 6,983,554 | B2 | 1/2006 | Watkins | |
| 7,078,091 | B2 | 7/2006 | Bonk et al. | |
| 7,086,179 | B2 * | 8/2006 | Dojan et al. | 36/29 |
| 7,395,616 | B2 * | 7/2008 | Fallon | 36/35 R |
| 7,707,745 | B2 * | 5/2010 | Schindler et al. | 36/29 |
| 2003/0200678 | A1 | 10/2003 | Nishiwaki et al. | |
| 2004/0168350 | A1 | 9/2004 | Mathieu et al. | |
| 2004/0237346 | A1 | 12/2004 | Rudy | |
| 2005/0120590 | A1 | 6/2005 | Ellis | |
| 2006/0277794 | A1 | 12/2006 | Schindler et al. | |
| 2007/0119075 | A1 | 5/2007 | Schindler | |

FOREIGN PATENT DOCUMENTS

| | | |
|---|---|---|
| WO | 2008097408 | 8/2008 |

OTHER PUBLICATIONS

International Preliminary Report on Patentability and the Written Opinion in corresponding PCT/US2008/078773 mailed Apr. 22, 2010.

Translation of first Office Action issued in corresponding Chinese Application No. 200810191131.7 dated Dec. 6, 2010.

Aug. 18, 2011 Office Action issued in corresponding European Application No. 08836855.0.

Jul. 29, 2011 Office Action issued in corresponding Chinese Application No. 2008101911317.

* cited by examiner

ARTICLE OF FOOTWEAR WITH SOLE STRUCTURE

FIELD OF THE DISCLOSURE

Aspects of the present disclosure generally relate to footwear, and more particularly to footwear that includes a fluid-filled bladder system located between an upper member and an outsole of the footwear structure.

BACKGROUND

Conventional footwear products, and particularly athletic shoes, have included two primary elements, namely an upper member and a sole member or structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground reaction forces, the sole structure may provide traction and control foot motions, such as pronation. Typically, the sole structure is attached to the upper member, e.g., using adhesives, stitching, welding, etc. Accordingly, the upper member and the sole structure operate cooperatively to provide a comfortable structure that is suited for a variety of ambulatory activities, such as walking and running.

The sole member or structure of athletic footwear generally has exhibited a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. Additional elements that attenuate ground reaction forces, or impacts, may include fluid-filled bladders that compress and deform to absorb the impact and thereby cushion the foot during the impact.

The present invention generally relates to new and novel sole structures for footwear that include one or more fluid-filled bladders.

SUMMARY

The following presents a general summary of aspects of the disclosure in order to provide a basic understanding of at least some of its aspects. This summary is not intended as an extensive overview of the disclosure. It is not intended to identify key or critical elements of the disclosure or to delineate the scope of the disclosure. The following summary merely presents some concepts of the disclosure in a general form as a prelude to the more detailed description provided below.

Aspects of this disclosure relate to footwear structures. Such structures may include an upper having a foot-receiving opening defined therein, wherein the upper defines an interior chamber and an exterior surface and a sole structure including a midsole, and an outsole. Such footwear structures may also have a heel plate and at least one lobe located between the upper and the outsole, wherein the at least one lobe extends laterally beyond a heel area of the upper (e.g. laterally outside of the footwear's heel counter perimeter, if any) and meets the heel plate at the lobe's edge that is laterally farthest away from the upper.

Additional aspects of this disclosure relate to an article of footwear with an upper and a sole structure including a midsole and an outsole. The footwear may also include a heel plate and at least one lobe located between the upper and the outsole. The lobe extends laterally beyond a heel area of the upper and meets the heel plate at the lobe's edge that is laterally farthest away from the upper so that the lobe is exposed. The lobe may be exposed such that when viewed from above, in a direction generally perpendicular to the sole (or generally downward from above), the lobe is at least partially visible beyond the sides of the heel area of the upper (e.g., outside the perimeter of the heel counter or other heel perimeter structure provided with the footwear structure).

In additional aspects of the disclosure the sole may include a heel plate that extends laterally beyond the heel counter and/or beyond the heel area perimeter of the upper. Further, the lobe may be a fluid-filled bladder (e.g., filled with air or other gas or fluid). Also, the footwear structure may include a plurality of lobes, such as three lobes, arranged around the heel area of the upper such that one lobe is positioned adjacent each of a medial side, a lateral side, and a rear side of a heel portion of the article of footwear. Further, the lobes may include a curved exterior extending between the midsole and the heel plate such that the curved exterior extends downwardly and away from the midsole toward the heel plate and so the curved exterior of the lobe terminates or meets the heel plate at a location where it is laterally farthest from the midsole. In such structures, the curved, exposed exterior portion of the lobe may not curve back toward an interior of the article of footwear.

BRIEF DESCRIPTION OF THE DRAWINGS

A more complete understanding of the present disclosure and certain advantages thereof may be acquired by referring to the following description in consideration with the accompanying drawings, in which like reference numbers indicate like features, and wherein.

DETAILED DESCRIPTION

In the following description of various example embodiments of the disclosure, reference is made to the accompanying drawings, which form a part hereof, and in which are shown by way of illustration various example structures and systems in which aspects of the disclosure may be practiced. It is to be understood that other specific arrangements of parts, structures, example devices, systems, and the like may be utilized and structural and functional modifications may be made without departing from the scope of the present disclosure. Also, while the terms "top," "bottom," "front," "back," "side," and the like may be used in this specification to describe various example features and elements of the disclosure, these terms are used herein as a matter of convenience, e.g. based on the example orientations shown in the figures and/or orientations during typical use (for example, when standing still). Nothing in this specification should be construed as requiring a specific three dimensional orientation of structures in order to fall within the scope of this disclosure.

Figure 1:
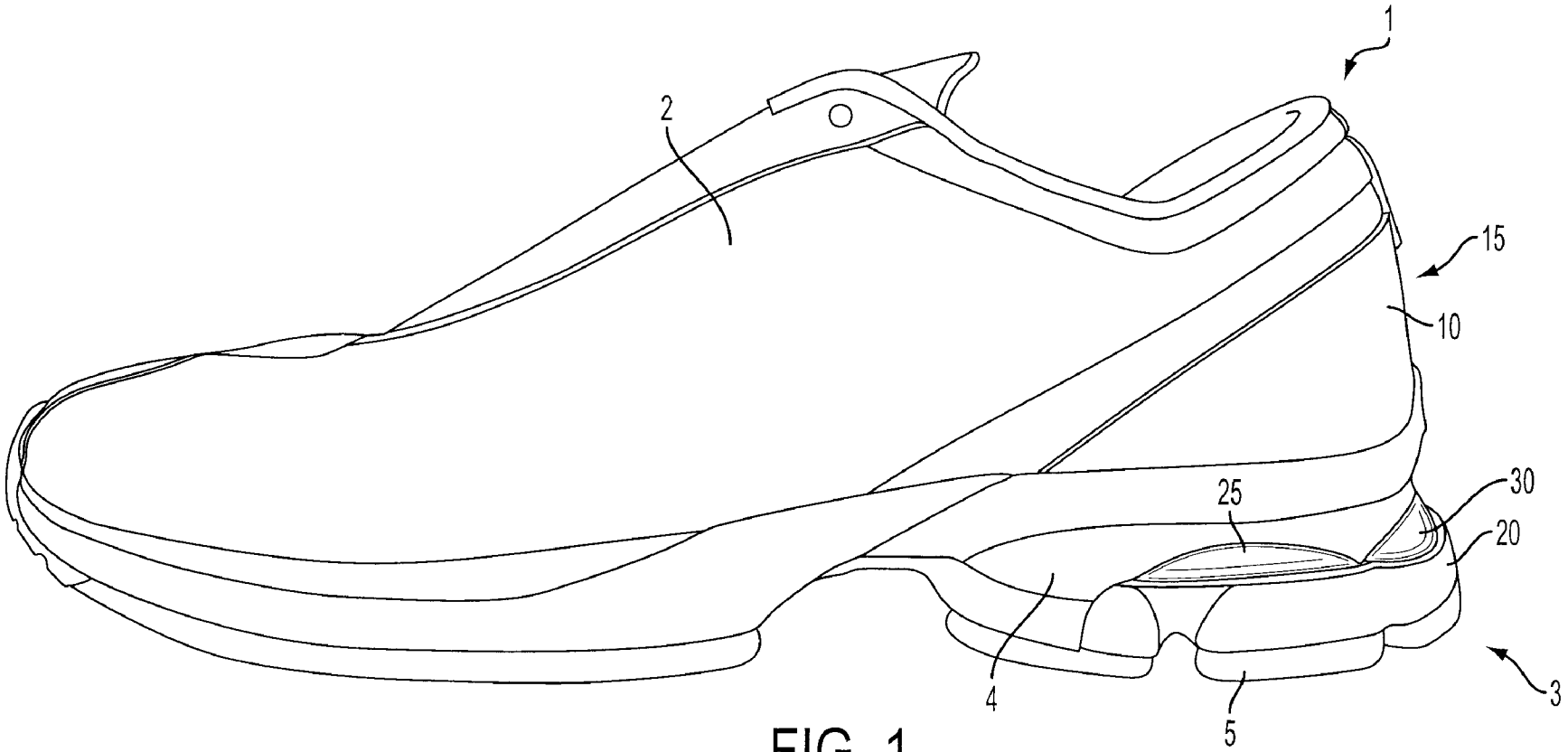
FIG. 1 illustrates a side view of an article of footwear according to at least some aspects of the disclosure.
Figure 2:
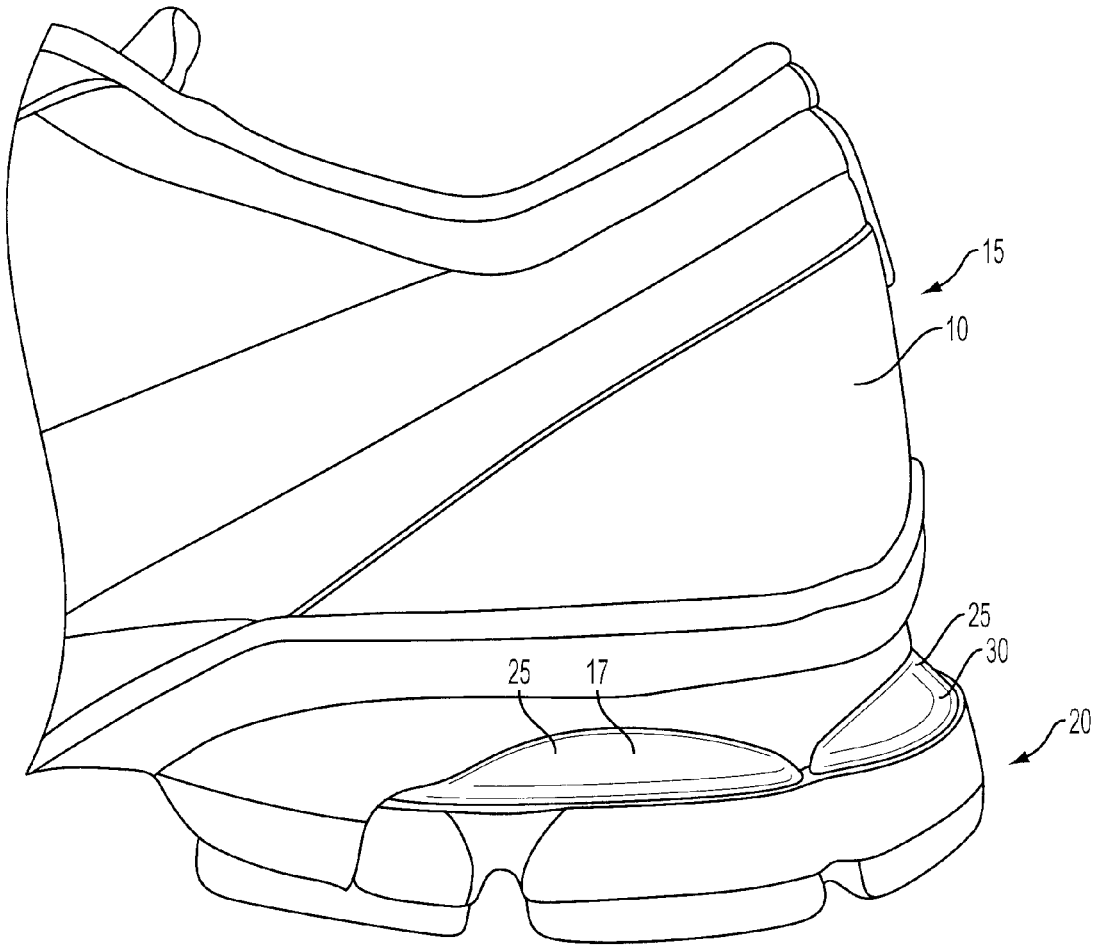
FIG. 2 illustrates a side view of the heel portion of the article of footwear shown in FIG. 1.

FIG. 1 shows a side view of an illustrative embodiment of an article of footwear according to at least some aspects of this disclosure. The article of footwear 1 has an upper 2 and a sole structure 3. The upper 2 may be made of any materials commonly known in the art, such as leather, foam, fabric, polymeric materials, etc. The sole structure 3 may be made of any materials commonly known in the art such as polymer foam material, rubber, etc. The sole structure 3 of this example footwear element 1 includes a midsole 4 and an outsole 5. FIG. 2 shows a heel portion 15 of the embodiment depicted in FIG. 1. As seen in FIG. 2, the heel area of upper 2 includes a heel counter 10. The heel counter 10 encircles the rear heel of the user from a medial side to lateral side of the heel. It defines a space in the footwear structure 1 for the wearer's heel and provides support for the heel. The heel counter 10 is part of the heel portion 15 of article of footwear. The footwear 1 may also include a heel plate 20 that extends out beyond the sides of the upper 2 and particularly beyond the sides of the heel area of the upper 2 (e.g., beyond the outer, rear and side perimeters of heel counter 10). As seen in the depicted embodiment, the heel plate 20 extends laterally outward from the heel portion of the footwear so that it is beyond the heel counter 10 on each of the medial, lateral and rear sides. The heel plate 20 may be separately attached or integrally molded with the rest of the sole, and it may form a portion of the midsole 4, outsole 5, or other structure in the article of footwear.

The heel plate may be enlarged relative to a heel plate sized to substantially correspond to the perimeter of the upper in a rear heel area or a heel counter's size and shape. This enlarged heel plate 20 may provide several features. For example, the enlarged heel plate 20 may provide additional stability for the footwear. More specifically, the enlarged heel plate 20 provides the sole structure 3 additional area around the heel to create a wider base. This wider base increases the stability of the footwear. For example, during an activity such as running or jogging, the wearer may have a stride wherein the heel makes contact with the ground before any other part of the footwear. Therefore, greater stability at the heel is desirable. In the disclosed embodiment, the additional area of the sole structure 3 on the medial and lateral sides can aid in creating additional stability during such a heel strike. Another consequence of the heel striking the ground before another part of the footwear is that the impact at the heel portion will be greater than at other parts of the footwear. By providing additional sole structure in the area around the heel, there is more area to add impact attenuating elements. The additional impact attenuating elements will aid to dissipate the impact forces from the heel strike. This will assist in attenuating the ground reaction forces caused by the impact of the heel on the ground.

The footwear in the depicted embodiment also has a fluid filled bladder 17. The fluid-filled bladder 17 can attenuate ground reaction forces or impacts. For example, the bladder 17 can aid in absorbing the impact forces caused by running, jumping or merely walking. The bladder 17 must be strong enough to withstand the repetitive impacts imparted to it during the normal wear, but the bladder 17 also must be flexible so as to absorb the impact forces imparted to the foot. The fluid in the bladder may be air or other gases. In such a case, the fluid-filled bladder 17 may be an airbag. The airbag may be made from a flexible material such as elastomer or plastic provided the material is both strong and flexible enough to realize the above features. Suitable fluid-filled bladder materials and constructions are known in the art, such as in commercially available footwear products marketed by NIKE, Inc. of Beaverton, Oreg., e.g., under various "AIR" brand trademarks.

Figure 3:
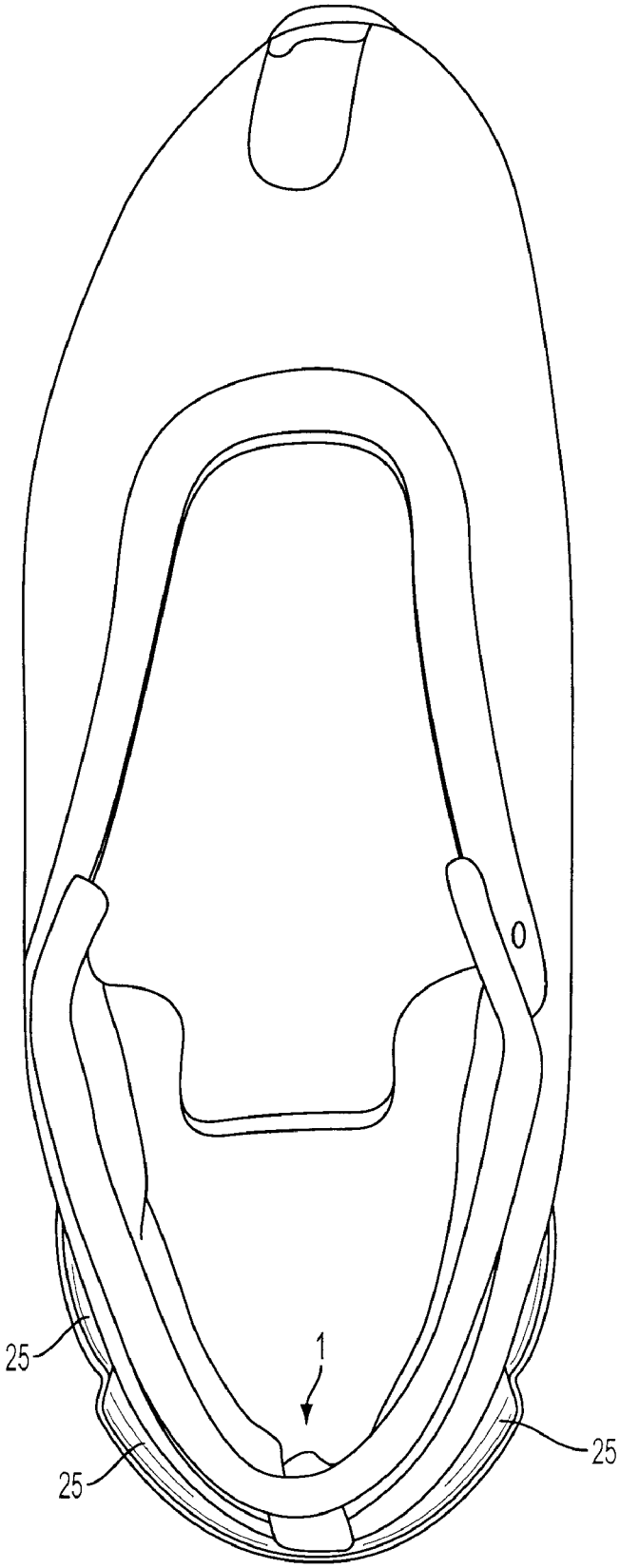
FIG. 3 illustrates a top view of the article of footwear shown in FIG. 1.
Figure 4:
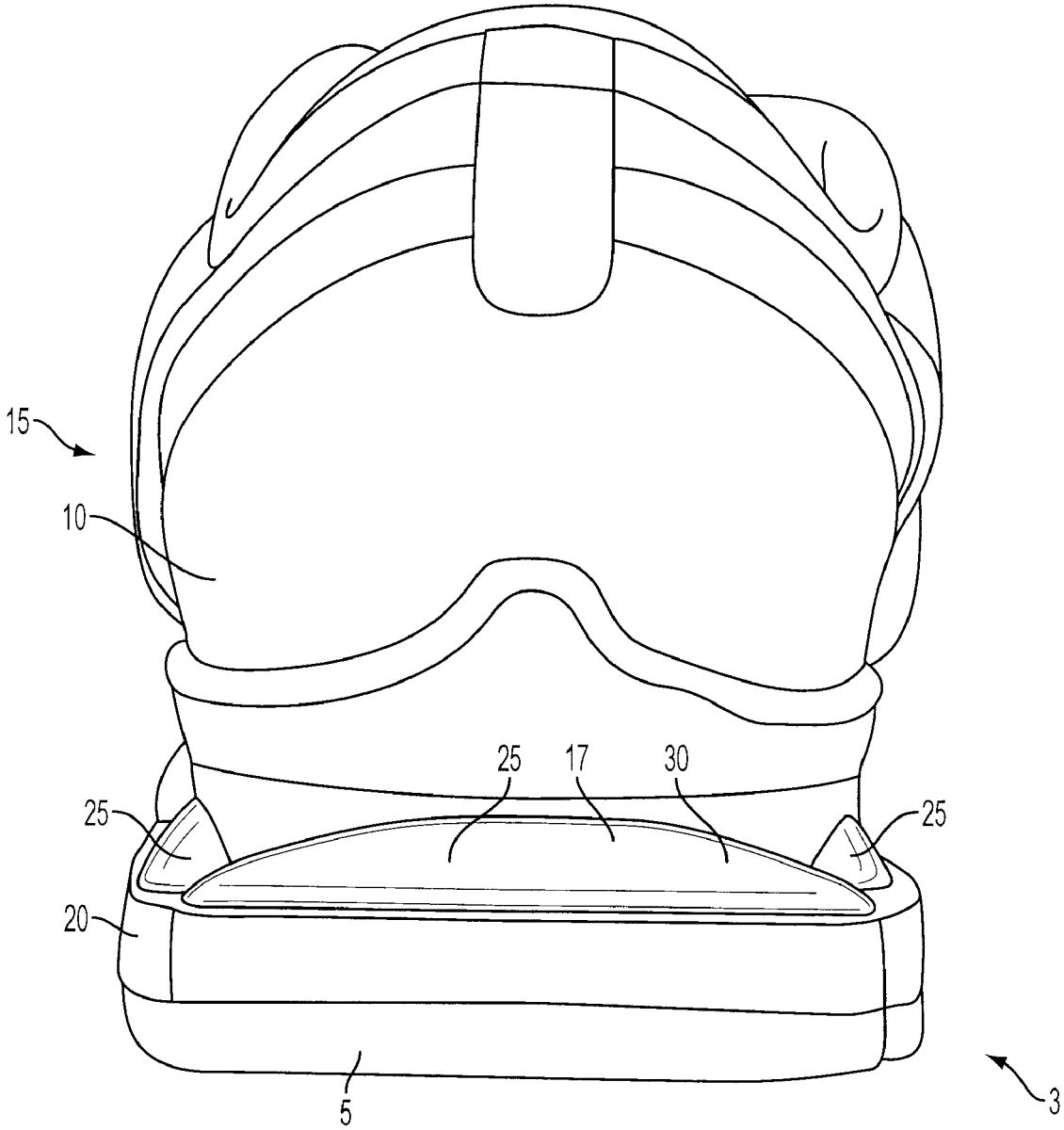
FIG. 4 illustrates a rear view of the article of footwear shown in FIG. 1.
Figure 5:
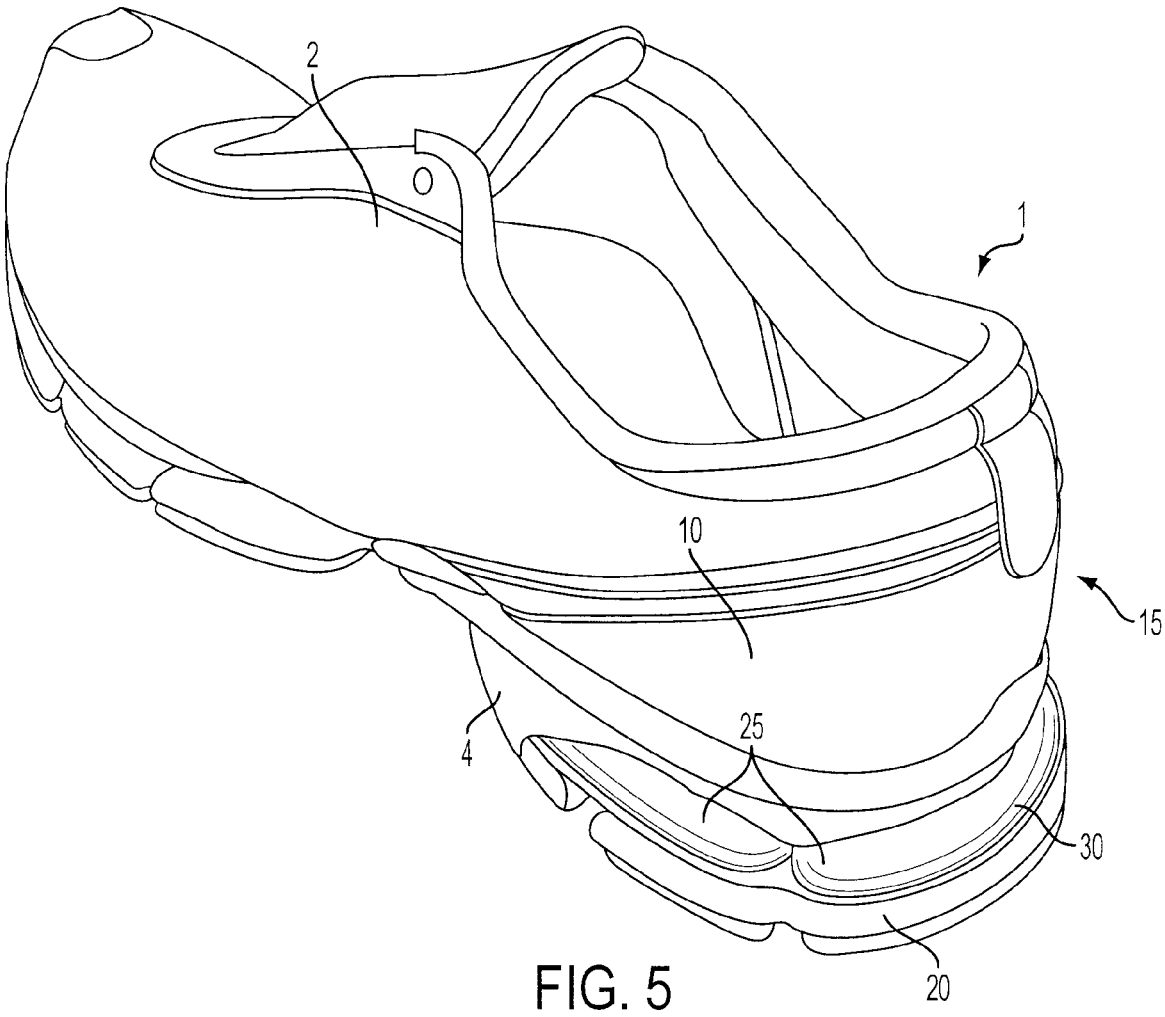
FIG. 5 illustrates a rear perspective view of the lateral side of the article of footwear shown in FIG. 1.
Figure 6:
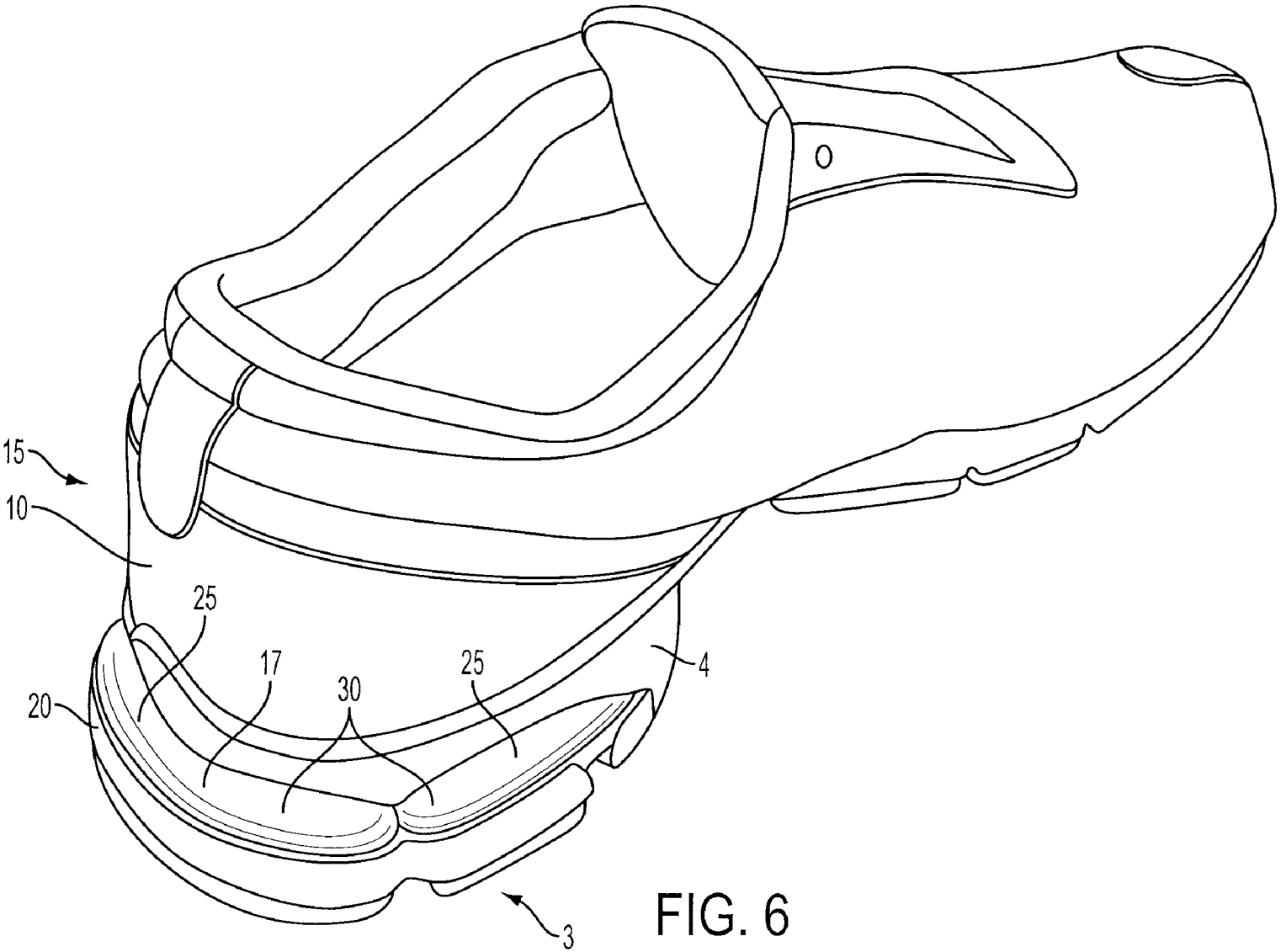
FIG. 6 illustrates a rear perspective view of the medial side of the article of footwear shown in FIG. 1.

The fluid-filled bladder 17 is positioned between the upper 2 and outsole 5. For example, the fluid-filled bladder 17 may be positioned at the midsole 4, within the midsole 4, between the midsole 4 and the outsole 5, between the upper 2 and the midsole 4, etc. The fluid-filled bladder 17 may include a single lobe or a plurality of lobes 25 positioned around the heel portion 15. In the depicted embodiment, a plurality of lobes 25 is shown and the lobes 25 are disposed at least partially on the enlarged heel plate 20. Further, as seen in FIGS. 3 and 4, there are three lobes, wherein a lobe is positioned at a rear side of the heel, a medial side of the heel and a lateral side of the heel. While the lobes 25 may all be incorporated as part of the same fluid-filled bladder 17, the lobes 25 may be separated from each other along the enlarged heel plate 20. As seen in FIG. 2, the lobes may be separate from each other along the enlarged heel plate 20. Such a structure, as shown in FIG. 2, will inherently enhance flexibility around the heel and along the heel plate. In other words, the separation between each of the separate lobes 25 will inherently allow more flexibility at the heel as compared with an integral structure, such as a single lobe extending around the enlarged heel plate 20. Further, the lobes 25 can take a variety of sizes depending on the number of lobes desired or the end use of the footwear. For example, as seen in FIGS. 3-6, the lobe at the rear side of the heel may be larger than the lobes at either the medial or lateral sides of the heel. Alternative embodiments (not shown), may also include three lobes 25, but the lobe at the rear side of the heel may be shorter than the lobes at either the medial or lateral side of the heel counter. Other variation in the sizes of the lobes are contemplated and considered within the scope of disclosure.

The fluid-filled bladder(s) 17 and/or lobe(s) 25 may rest on a top surface of the heel plate 20, e.g., as shown in FIG. 2. If desired, the top surface of heel plate 20 may include grooves or depressions so that the fluid-filled bladder(s) nests within or sits down in the plate structure 20. If desired, the fluid-filled bladder(s) 17 may be engaged with the plate 20, e.g., via cements or adhesives, via stitching or sewing, via mechanical connectors, etc.

As shown in FIG. 2, the lobes 25 of the fluid-filled bladder 17 extend laterally in a generally curved manner between the midsole 4 and the enlarged heel plate 20. The lobes may have a curved, exposed exterior 30 extending between the midsole 4 and the enlarged heel plate 20 so that the curved and exposed portion of the exterior 30 extends downwardly and away from the midsole 4 to the enlarged heel plate 20. As seen in FIGS. 2 and 4, the curved, exposed exteriors 30 of the lobes may terminate at the portions of the lobes' perimeters that are laterally farthest from the upper 2. In other words, the curved, exposed exteriors of the lobes do not extend any lower than the point where they are laterally farthest from the upper 2. Therefore, the curved and exposed portions of the exteriors 30 of the lobes do not curve back toward an interior of the article of footwear. This provides the lobes with rounded shape that end (or at least appears to end) at the location where the lobe meets the heel plate (or the lobe extends below the exposed surface of the heel plate at this laterally farthest outward location).

As seen in FIGS. 1-6, the lobes 25 of the fluid-filled bladder may be exposed. In other words, portions of the surfaces of the lobes border empty space. By exposing the lobes 25 of the air bladder 17, the lobes 25 may more easily expand or deform because they deflect into empty space rather than being confined between other elements such as polymer foam material. For example, consider a fluid-filled bladder in the midsole wherein substantially the entire bladder is surrounded and constrained by foam. Under a predetermined force, that bladder would only deform a particular amount because the bladder is constrained by the foam. On the other hand, in the depicted embodiment of this disclosure, under the same predetermined force, the same bladder would deform to a greater extent, because the lobes 25 of the bladder 17 are not constrained by foam. This greater amount of deformation of the bladder 17 through the exposed lobes 25 accentuates the impact force attenuating properties of the shock absorbing fluid-filled bladder 17. This is because the more the bladder 17 deforms, the more the impact can be attenuated and the less the impact force that is transferred to the foot.

A further feature of the exposed bladder 17 is that less material, such as polymer foam material, is needed for the footwear. Because the bladder does not have to be surrounded by the polymer foam material, less of such material is need for creating the shoe. Therefore, the shoe will be lighter in weight and less expensive to produce.

In the depicted embodiment, the greater amount of deformation of the fluid-filled bladder 17 is due, in part, to the heel plate 20 being enlarged. Compared to a heel plate sized to substantially correspond to the perimeter of the upper in the rear heel area or a heel counter's size and shape, the enlarged heel plate 20 provides additional room for the bladder 17 to be exposed to empty space. As shown in the FIG. 2, the lobes 25 substantially cover the top of the enlarged heel plate 20. Therefore, extending the heel plate 20 laterally relative to the heel counter 10 of the upper 2 provides additional room for the lobes 25 to extend. Hence, the lobes 25 are larger and the exposed area of the bladder 17 is greater. The greater the exposed area of the bladder 17, the more easily the bladder 17 can deform. Therefore, the enlarged heel plate 20 allows the footwear to provide more impact force attenuation properties to the foot of the user.

Further, as mentioned above in the disclosed embodiment the lobes' curved exteriors 30 between the midsole 4 and the enlarged heel plate 20 are exposed. This is due, in part, to the enlarged heel plate 20 which allows the lobes to extend farther out beyond the heel area of the upper. In this way, when the footwear 1 is viewed from above, in a direction generally perpendicular to the sole 3, the lobes 25 are at least partially visible extending beyond a perimeter of the heel area of the upper 2. For example, in the depicted embodiment, which has a lobe 25 positioned at each of a rear, medial and lateral side of the heel, all three lobes would be at least partially visible when viewed from above. This is shown in the FIG. 3. A consequence of the lobes being exposed is that they are exposed to the same conditions as the outer portion of the footwear is exposed. Therefore, the lobes should be made from a material that is strong enough to withstand such conditions. However, also the lobes must flexible so as deform and to absorb impacts to cushion the foot. The lobes may be made from a flexible material, such as elastomer or plastic, provided that the material is both strong and flexible enough to realize the above features.

Articles of footwear or components thereof may have a variety of different properties without departing from the invention. For example, while the "lobes" have generally been described herein as exposed portions of a fluid-filled bladder, this is not a requirement. Rather, if desired, the lobes may constitute a foam or other impact-attenuating material (e.g., polyurethane form or ethylvinylacetate foam material) that extends outward from a portion of the sole structure, e.g. through openings or "windows" provided in the sole structure (e.g., openings in the midsole, openings provided between the midsole and a heel plate and/or the outsole, etc.). As another example, any desired number of "lobes" and/or openings therefore may be provided in a footwear structure without departing from this invention. Not every lobe in a given footwear structure need have the same size, shape, and/or construction (e.g., one lobe may be from a fluid-filled bladder while another lobe may be a foam or other material, etc.).

As yet another example, if desired, the lobes may be formed as a single, one-piece structure, such as a single fluid-filled bladder structure or foam element structure, having the desired shape and number of lobes. Alternatively, if desired, multiple lobe containing elements may be included in a footwear structure (e.g., each lobe constituting a single and independent fluid-filled bladder or foam structure, multiple fluid-filled bladders or foam structures in a given footwear structure wherein each includes one or more independent lobes, etc.).

Footwear structures in accordance with examples of this invention may include additional features, including conventional features of footwear that are known and used in the art (e.g., laces, buckles, or other securing structures, etc.). Also, aspects of this invention may be practiced in any type of footwear or other foot-receiving device structure, such as athletic shoes, dress shoes, sandals, sport specific shoes, ski boots, etc.

The articles of footwear described herein also show the lobes openly and completely exposed to the exterior environment. This also is not a requirement. For example, if desired, the article of footwear may include a cage or other structural member overlaying the exposed exterior surface of one or more of the lobes, e.g. to protect it from the environment, sharp objects, damage, abrasion, or the like.

Therefore, while the disclosure has been described with respect to specific examples including presently preferred modes of carrying out the disclosure, those skilled in the art will appreciate that there are numerous variations and permutations of the above described structures and methods. Thus, the spirit and scope of the disclosure should be construed broadly as set forth in the appended claims.

We claim:

1. An article of footwear, comprising:

an upper;

a sole including an outsole and a midsole;

at least one lobe located between the upper and the outsole, wherein the at least one lobe extends laterally beyond a heel area of the upper and meets the sole at a lobe edge located laterally farthest away from the upper; and a heel plate that extends laterally beyond the heel area of the upper, wherein the lobe ends at a location where the lobe edge located laterally farthest away from the upper meets a top surface of the heel plate, wherein said lobe includes a curved exterior extending between the midsole and the heel plate so that the curved exterior extends downwardly and away from the midsole to the heel plate and so that the curved exterior of the lobe terminates at the lobe edge located laterally farthest away from the upper, wherein the heel plate extends laterally and outwardly beyond the curved exterior of the lobe at the lobe edge located laterally farthest away from the upper, so as to form an exposed portion of the top surface of the heel plate.

2. An article of footwear according to claim 1, wherein an exposed portion of the curved exterior of the lobe does not curve back toward an interior of the article of footwear when viewed in a direction extending from the midsole to the heel plate.

3. An article of footwear according to claim 2, wherein the exposed portion of the curved exterior of the lobe between the midsole and the heel plate is shaped and positioned so that when the article of footwear is viewed from above, in a direction perpendicular to the sole, the lobe is at least partially visible extending beyond a perimeter of the heel area of the upper.

4. An article of footwear according to claim 3, wherein the at least one lobe is a plurality of lobes.

5. An article of footwear according to claim 4, wherein the plurality of lobes is three lobes, and further wherein one of the lobes is positioned at each of a lateral, medial and rear side of a heel portion of the article of footwear.

6. An article of footwear according to claim 5, wherein each lobe constitutes a portion of a fluid-filled bladder.

7. An article of footwear according to claim 5, wherein the three lobes are connected and form portions of a single fluid-filled bladder.

8. The article of footwear according to claim 7, wherein each of the lobes has a curved exterior extending along the heel plate, and wherein the curved exteriors are separated from one another.

9. An article of footwear according to claim 8, wherein the exposed curved exteriors of the lobes deform when a force is applied to the fluid-filled bladder and further wherein they deform more readily than the remainder of the fluid-filled bladder which is not exposed.

10. An article of footwear according to claim 9, wherein the exposed curved exterior of the lobe at the rear side of the heel is larger than the exposed curved exteriors of the lobes at either the medial or lateral side of the heel.

11. An article of footwear comprising:

an upper;

a sole including a midsole, an outsole and a heel plate, wherein a portion of the heel plate extends beyond the upper; and a fluid-filled bladder located between the upper and the outsole, wherein said fluid-filled bladder includes a plurality of lobes positioned around a heel area of the upper, adjacent the heel medial, lateral, and rear sides, and further wherein the plurality of lobes extend beyond the upper so that the lobes extend to the heel plate at portions of the lobes' perimeters that are laterally farthest from the upper, wherein the lobes end at a location where the lobe meets the heel plate, wherein exposed portions of the lobes curve downwardly and away from the midsole toward the heel plate so as to terminate where the lobes meet the heel plate and thereby the exposed portions of the lobes do not curve back toward an interior of the article of footwear when viewed in a direction extending from the midsole to the heel plate, wherein the heel plate includes an exposed top surface which extends substantially parallel to the sole, wherein the top surface of the heel plate extends outwardly beyond the lobes at a level wherein the lobes meet the heel plate.

12. An article of footwear according to claim 11, wherein the lobes are visibly exposed between the midsole and the heel plate so that the lobes can be at least partially seen when the article of footwear is viewed from above in a direction perpendicular to the sole.

13. An article of footwear according to claim 12, wherein the lobes also are separated from each other along the exposed top portion of the heel plate.

14. An article of footwear according to claim 13, wherein the plurality of lobes is three lobes and one of the lobes is positioned at each of the lateral side, medial side and rear side of the heel.

15. An article of footwear according to claim 14, wherein the exposed portion of the lobe at the rear side of the heel is larger than the exposed portions of either of the lobes at the medial or lateral sides of the heel.

16. An article of footwear according to claim 12, wherein the lobes deform more readily at their exposed sections between the midsole and the extended heel plate than the remainder of the fluid-filled bladder which is not exposed.

17. An article of footwear, comprising:

an upper including a heel area;

a sole structure engaged with the upper, wherein at least one of the upper, the sole structure, or an area between the upper and the sole structure defines a first opening that extends to an interior chamber provided within the article of footwear, and wherein the sole structure includes a heel plate member; and an impact-attenuating member engaged with at least one of the upper or the sole structure, wherein the impact-attenuating member includes a first portion that extends through the First opening to an exterior of the article of footwear, adjacent to the heel plate member and laterally beyond a perimeter of the heel area of the upper, wherein at least one of the upper, the sole structure, or the area between the upper and the sole structure defines a second opening that extends to the interior chamber, and wherein the impact-attenuating member includes a second portion that extends through the second opening to the exterior of the article of footwear, adjacent to the heel plate member and laterally beyond the perimeter of the heel area of the upper, wherein at least one of the upper, the sole structure, or the area between the upper and the sole structure defines a third opening that extends to the interior chamber, and wherein the impact-attenuating member includes a third portion that extends through the third opening to the exterior of the article of footwear, adjacent to the heel plate member and laterally beyond the perimeter of the heel area of the upper wherein the impact-attenuating member is a fluid-filled bladder, wherein the first portion of the impact-attenuating member is located on a medial side of the article of footwear, wherein the second portion of the impact-attenuating member is located on a lateral side of the article of footwear, and wherein the third portion of the impact-attenuating member is located on a rear heel portion of the article of footwear wherein the first, second and third portions of the impact-attenuating member are lobes which end at a location where the lobes meet the heel plate member, wherein exposed portions of the lobes curve downwardly and away from the midsole toward the heel plate member so as to terminate where the lobes meet the heel plate member and thereby the exposed portions of the lobes do not curve back toward an interior of the article of footwear when viewed in a direction extending from the midsole to the heel plate, wherein the heel plate member includes an exposed top surface which extends substantially parallel to the sole, wherein the top surface of the heel plate member extends outwardly beyond the lobes at a level wherein the lobes meet the heel plate member.

18. An article of footwear according to claim 17, wherein the first portion of the impact-attenuating member does not extend laterally beyond the heel plate member.

* * * * *

UNITED STATES PATENT AND TRADEMARK OFFICE

CERTIFICATE OF CORRECTION

PATENT NO. : 8,266,826 B2
APPLICATION NO. : 11/869506
DATED : September 18, 2012
INVENTOR(S) : Patrick Cassiday et al.

It is certified that error appears in the above-identified patent and that said Letters Patent is hereby corrected as shown below:

In the Claims:

Column 8, Claim 17, Line 38:
Please delete "First" and replace with --first--

Signed and Sealed this
Second Day of July, 2013

Teresa Stanek Rea
*Acting Director of the United States Patent and Trademark Office*